United States Patent [19]

Soloman

[11] Patent Number: 4,494,809

[45] Date of Patent: Jan. 22, 1985

[54] SECURITY ATTACHMENT FOR ELECTRICAL PLUG

[76] Inventor: Leonard Soloman, 156 Shoreview Dr., Chelsea, Mich. 48118

[21] Appl. No.: 466,406

[22] Filed: Feb. 15, 1983

[51] Int. Cl.[3] ..... H01R 13/621

[52] U.S. Cl. ..... 339/75 P; 339/37; 339/82; 339/154 A

[58] Field of Search ..... 339/37, 75 P, 82, 154 R, 339/154 A, 155, 156 R

[56] References Cited

U.S. PATENT DOCUMENTS 3,363,214 1/1968 Wright ..... 339/154 R 3,811,104 5/1974 Caldwell ..... 339/75 P

*Primary Examiner*—John McQuade

*Attorney, Agent, or Firm*—Stephenson and Boller

[57] ABSTRACT

A security attachment for an electrical plug is effective to prevent unauthorized use but to readily permit authorized use. It comprises a pair of adapter elements which are mutually plugged together between the electrical plug and a wall receptacle. One adapter is plugged together with the electrical plug and the two are connected together such that they cannot become unplugged if an attempt is made to unplug them. When unauthorized use is to be prevented, the other adapter is removed to expose prongs of the first adapter which prevent the first adapter from being plugged into the wall receptacle.

18 Claims, 3 Drawing Figures

SECURITY ATTACHMENT FOR ELECTRICAL PLUG

BACKGROUND AND SUMMARY OF THE INVENTION

This invention relates to a security attachment for an electrical plug which is effective to prevent unauthorized use but which readily permits authorized use.

In the United States, household electrical appliances are typically provided with plugs which are intended to be connected into electrical wall receptacles. The plug is usually a two prong type comprising a nonconductive body containing two electrical terminals. An insulated wire containing two separate conductors leads from the plug to the electrical appliance. One conductor of the wire connects to one prong within the plug body while the other wire connects to the other prong also within the plug body. The wall receptacle comprises two sockets containing terminals into which the prongs of the plug are plugged. The receptacle socket terminals are "live", meaning that a voltage exists across them which can be used to power the electrical appliance containing the plug. Hence, when the plug is plugged into the receptacle, circuit continuity is established such that current can flow to the appliance via one conductor and return via the other conductor. Typically the power supplied to household wall receptacles in the United States is 115 volts, 60 hertz AC, and hence the current flow is of alternating polarity at the AC frequency For any of a number of various reasons it may be desirable to control the usage of an electrical appliance so as to prevent unauthorized use yet permit authorized use. For example, with the advent of home video games, children can become addicted to playing them, and hence parental control of the use of such video games becomes very important. Unfortunately, it may not always be convenient for parental supervision to be exercised, such as for example when both parents are working and the children come home from school before the parents come home from work.

A novelty search conducted in connection with this invention has revealed that the prior art contains a myriad of electrical security devices for preventing unauthorized use and permitting authorized use. A vast majority of prior devices comprise lockouts in which either the plug or the receptacle is physically locked out by means of a locking device which prevents mating engagement of a plug and receptacle. U.S. Pat. No. 3,416,123 is an example of a lockout type device applied to an electrical plug.

Many of these prior lockout devices are key operated and contain a lock mechanism. The authorized user controls the key, and hence it is possible for that person to apply the lock to the plug so that use of the appliance or device containing the plug is prevented until such time as he or she returns with the key to unlock the lock. In order to provide adequate security, such locks must often be of sufficient size and strength so that they may be relatively expensive.

The present invention is directed to a security attachment for an electrical plug which is effective to control use of a device containing the plug yet which is considerably less complicated than the locking devices of the prior art. It is deemed to be highly effective in controlling use of electrical devices such as video games by children. It does not require a locking mechanism in the sense of prior locking device utilizing padlocks, combination locks, etc. Rather, it employs two electrical adapters arranged in a new and unique manner. One adapter, in the preferred embodiment, is connected to the plug in a manner effective to prevent the two from being unplugged and to discourage children from attempting to defeat the connection. It also has prongs which are impossible to connect into the receptacle. Authorized use is permitted by plugging the second adapter into the first. When the two adapters are so plugged together, the second adapter comprises prongs which can be plugged into the wall receptacle. In this way, the two adapters, when plugged together and between the receptacle and the plug, provide electric circuit continuity from the receptacle to the plug such that electrical power from the receptacle is delivered to the electrical device or appliance containing the plug.

One advantage of the preferred embodiment of the invention as disclosed herein is that it can be sold in kit form for use with existing appliances. In other words, the owner of an electrical appliance can buy the kit, install it on the appliance plug, and control use of the appliance. First, the owner plugs the plug of the appliance into the first adapter; he or she then installs the connector which connects the first adapter to the plug to prevent the two from being unplugged. The owner then controls the use of the second adapter to thereby exercise control over use of the appliance.

The search referred to above also developed U.S. Pat. Nos. 2,761,109; 3,161,450; and 3,363,214. While the last-mentioned patent involves the use of two adapters between a plug and a receptacle, it is neither involved with nor suited for unauthorized use prevention.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
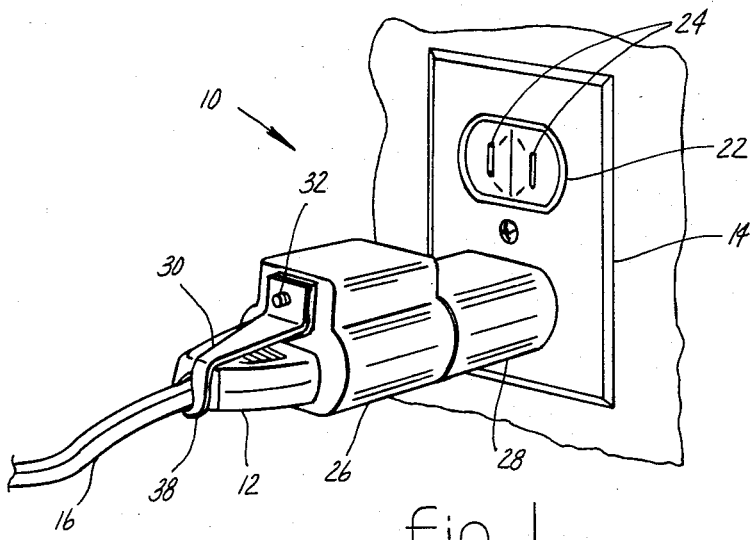
FIG. 1 is a prespective view of one embodiment of the invention in use.

The embodiment of security attachment in FIG. 1 is designated by the general reference numeral 10. It is illustrated in use between an electrical plug 12 and one receptacle of a two receptacle wall outlet 14.

Figure 2:
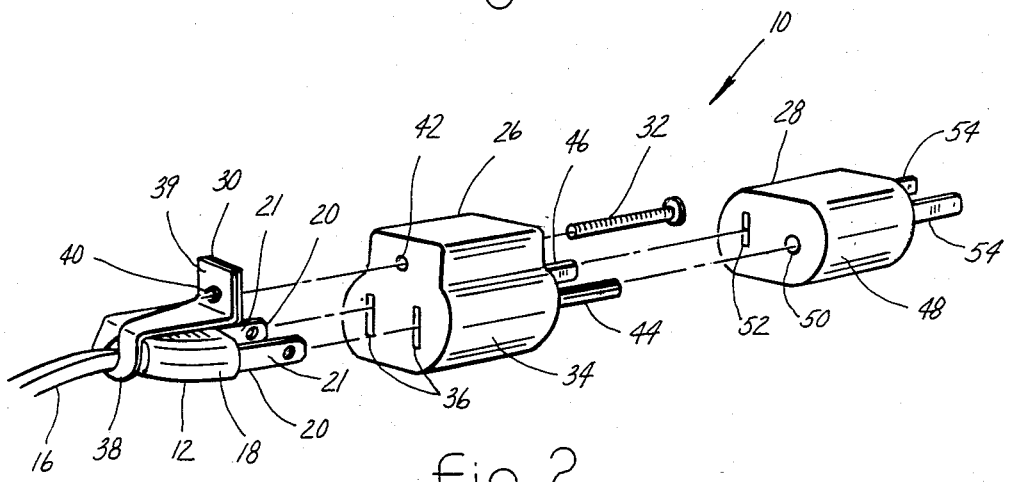
FIG. 2 is a partial exploded view of FIG. 1.

The components, with the exception of the wall outlet receptacle 14, are shown in exploded form in FIG. 2. Plug 12 is at the end of a wire 16 which leads to an electrical device or appliance (not shown) which is energized via the plug and wire. The illustrated wire 16 is an insulated, two conductor construction. Each conductor of the wire is connected within the electrically non-conducting body 18 of the plug to a corresponding one of a pair of electrical terminals 20. The terminals 20 include exterior portions, or prongs, 21 which project from the non-conducting body 18 in a parallel fashion so as to render the plug connectible with one of the wall outlet receptacles.

As can be seen in FIG. 1 the upper wall outlet receptacle, which is designated by the reference numeral 22, comprises a pair of sockets 24, each containing an electrical terminal. The prongs 21 of terminals 20 which project from body 18 may be considered as male terminals and the terminals within the sockets 24 may be considered as female terminals. The lower receptacle (unnumbered) into which the security attachment is plugged is identical to the upper receptacle. Hence, absent the security attachment of the present invention, plug 12 is readily insertable at will into the electrical outlet to provide power to the appliance containing plug 12. In the case of a video game, children can readily insert the plug 12 into the wall outlet receptacle.

The embodiment 10 of security attachment comprises a first adapter 26, a second adapter 28, a connector bracket 30, and a fastener 32. Adapter 26 and plug 12 are intended to be plugged together and connected so as to prevent them from becoming unplugged. For this purpose, adapter 26 contains a pair of electrical conductors within its non-conducting body 34. At the end of the adapter which is to be plugged into plug 12, these conductors terminate in a pair of female terminals 36 (sockets) which connect with prongs 21 of the plug. Hence, the plug can be essentially fully plugged into the first adapter to place the confronting ends of their respective bodies in substantial abutment as shown in FIG. 1.

Bracket 30 is a formed metal element having and encircling portion 38 looped around wire 16 just behind plug body 18. The bracket continues from portion 38 as a pair of overlapped sections extending lengthwise along the top side of the plug body and terminating in upstanding right angle flanges 39. Holes 40 are provided in the upstanding right angle flanges. With adapter 26 and plug 12 plugged together, a hole 42 extending axially completely through the body 34 of adapter 26 is in alignment with the holes 40 in the bracket. Fastener 32 is a screw whose shank passes through hole 42 and is threaded into the holes 40 of the bracket. The head of the fastener 32 may be of a construction which prevents convenient unfastening. For example it may be a one-way drive head which only allows the screw to be threaded into engagement with the bracket and not to be unthreaded. This would be essentially a permanent attachment which could be broken only destructively such as by cutting the bracket or by drilling out the head of the screw. Alternatively the fastener 32 need not be a one-way drive type. It could have its head countersunk into the hole 42 so that its existence is not readily apparent to one attempting to separate the adapter from its connection with the plug. This latter alternative is a suitable arrangement to discourage many children from successfully disconnecting the adapter from the plug.

The opposite ends of the two conductors extending through adapter 26 comprise terminals 44 and 46. The terminals 44 and 46 are constructed and arranged in such a manner that they cannot be plugged into the wall outlet receptacle in a manner which will be effective to establish electrical circuit continuity so that power can be supplied to the electrical device containing plug 12. The illustrated construction for these projecting terminals comprise terminal 44 being in the form of a round pin and the terminal 46 being in the form of a flat blade. Hence, with adapter 26 installed and without the second adapter 28, it is impossible for unauthorized use of the appliance to occur.

Authorized use is permitted by the second adapter element 28. This adapter element comprises a non-conducting body 48 containing a pair of conductors. It is intended to be plugged onto the first adapter element 26. For this purpose it comprises at one end a set of terminals 50 and 52 which correspond to terminals 44 and 46 respectively such that electrical circuit continuity is established between the conductors of the two adapters when they are plugged together. Thus for the illustrated construction, the terminal 50 will be a circular receptacle within body 48 while the terminal 52 will be constructed to receive the flat blade 46 within body 48. The terminals 50 and 52 may be considered as female terminals.

The conductors of adapter 28 terminate at the far end as viewed in FIG. 2 in a pair of terminals 54 which are arranged and constructed to be plugged in to the wall outlet receptacle. Hence they are essentially identical with prongs 21 of plug 12. Therefore, when the two adapter elements 26, 28 are plugged together, and the terminals 54 are plugged into the wall outlet receptacle, electric circuit continuity is established from the wall outlet receptacle through the two adapters to plug 12 so that power can be supplied to the device or appliance containing plug 12.

It will be noted that adapter 28 is strictly of a plug-in type connection, both with the wall outlet receptacle and with adapter 26. The individual who controls possession of adapter 28 controls use of the appliance. In the case of a video game and children, a parent can keep the adapter 28 in his or her possession during times when the children are not allowed to use the game. For example, if the children come home from school and the parents are not home, the children will be unable to plug the game into a wall receptacle because the terminals 44 and 46 of the first adapter 26 do not permit connection to a receptacle. Moreover, many children will be neither perceptive nor persistent enough to defeat the system because they will be unable to separate the first adapter element from the plug. In this way unauthorized use of the video game will be prevented. When the parent returns home, he or she can connect the second adapter 28 between the first adapter 26 and the wall outlet receptacle so that authorized use is permitted. This is a convenient procedure for the parent since it involves only a plug-in connection of the adapter 28 and does not require the use of any separate tools, keys or combination locks.

By making the connection of the first adapter 26 to the plug 12 of a construction which can be disconnected only by destruction of some type, a parent will ascertain if a child has attempted to defeat, or has in fact defeated the purpose of the security attachment. Thus, the invention is particularly advantageous in that it is a relatively inexpensive device which can be easily installed in the home and which is highly effective in many situations where unauthorized use is intended to be prevented.

Figure 3:
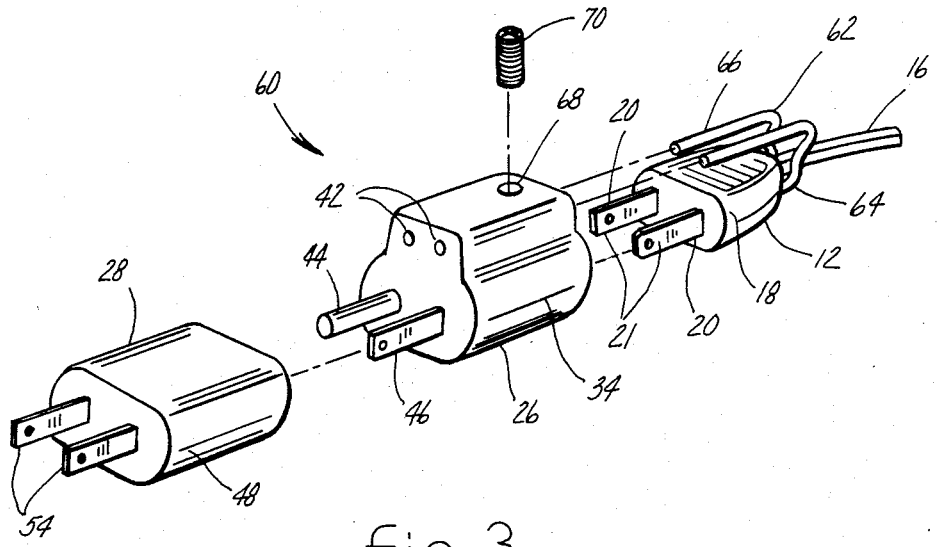
FIG. 3 is an exploded perspective view of another embodiment of the invention as viewed in the opposite direction from FIGS. 1 and 2.

FIG. 3 illustrates an alternate construction 60 for the security attachment which differes in the details of the connection between the plug and first adapter. In all other respects, the construction is the same as the first embodiment, and like reference numerals identify like parts. In the FIG. 3 embodiment, the connector element is a formed wire rod 62 one end of which (numeral 64) is looped around wire 16 just behind the plug body 18. The opposite ends 66 extend straight axially toward adapter 26, and beyond the end of the plug body so that when plug 12 is plugged into adapter 26, the straight axial sections 66 of the bracket fit into the holes 42, there being two holes 42 in the first adapter 26 of FIG. 3.

The body of adapter 26 is provided with a further hole 68 which is at a right angle to and centered between holes 42. It is open toward the top of the adapter body as viewed in FIG. 3 and it intersects both holes 42. A fastener such as a set screw 70 is threaded into hole 68 to fit between the axial ends 66 of the wire and force them apart against the walls of their respective holes 42. The set screw, when tightened, is below the level of the top of the adapter body so that it is not prominent. The use of a set screw is advantageous in that it may be provided with a socket of a non-standard configuration which requires a unique tool for its insertion and removal. This tool could be sold as a part of the security attachment. However, it is possible to use a construction containing a simple diametrical slot or a conventional hex so that conventional tools can be used.

While a preferred embodiment of the invention has been disclosed, it will be appreciated that principles are applicable to other embodiments. For example different shapes and patterns for the various components are possible. It is also possible that the connection of the first adapter element with the plug could be made internally and integrally.

What is claimed is:

1. As an authorized use permitter and unauthorized use preventer for connection between an electrical receptacle having plural terminals of a given construction and pattern and an electrical plug having plural terminals of a construction and pattern which allow the plug and receptacle to be plugged together to establish electric circuit continuity between the terminals of the plug and those of the receptacle, a security attachment comprising first and second adapters, each adapter comprising its own non-conducting body and a pair of electrical conductors therein terminating at respective ends thereof in respective first and second sets of terminals, said first set of terminals of said first adapter comprising plural terminals constructed and arranged to allow the plug and said first adapter to be plugged together to establish electric circuit continuity between the terminals of the plug and said conductors of said first adapter, said first set of terminals of said second adapter comprising plural terminals constructed and arranged to allow the receptacle and said second adapter to be plugged together to establish electric circuit continuity between the terminals of the receptacle and said conductors of said second adapter, said two adapters having their second sets of terminals constructed and arranged for mutual engagement to establish electric circuit continuity between their respective electrical conductors so that electric circuit continuity will thereby be established between the terminals of the plug and those of the receptacle via said two adapters when the latter are associated with their second sets of terminals in mutual engagement and with their first sets of terminals respectively plugged together with the plug and the receptacle respectively, said second set of terminals of said first adapter being constructed and arranged to preclude the possibility of establishing electric circuit continuity with the terminals of the receptacle if an attempt is made to plug together said second set of terminals of said first adapter and those of the receptacle, and means providing for connection of said first adapter with the plug to prevent the two from becoming unplugged after they have been plugged together.

2. A security attachment as set forth in claim 1 in which said first set of terminals of said first adapter are female type terminals and said first set of terminals of said second adapter are male type terminals.

3. A security attachment as set forth in claim 2 in which said second set of terminals of said first adapter are male type terminals.

4. A security attachment as set forth in claim 3 in which said second set of terminals of said first adapter comprise one flat blade type terminal and one round pin type terminal.

5. A security attachment as set forth in claim 1 in which said means providing for connection of said first adapter with the plug comprises means providing for a connection which is independent of the mutually engaged terminals of said first adapter and the plug.

6. A security attachment as set forth in claim 5 in which the plug comprises a non-conductive body with insulated wire conductors leading away from the body and connected with the terminals of the plug and wherein said means providing for connection of said first adapter with the plug comprises a connector element having a portion for disposition just behind the plug body to substantially encircle an insulated wire leading to the plug and another portion spaced from said first-mentioned portion and a fastener operatively engaging the body of said first adapter and connecting with said another portion of said connector element to secure said connector element and said first adapter together.

7. A security attachment as set forth in claim 6 in which said fastener is of a type which precludes non-destructive unfastening.

8. A security attachment as set forth in claim 6 in which said connector element comprises a wire element having a straight shank constituting said another portion and disposed in a hole in the body of said first adapter, and said fastener comprises a threaded fastening element disposed in another hole in the body of said first adapter intersecting said first-mentioned hole, said fastener being fastened into said another hole and against said shank of said wire element to prevent said first adapter and plug from being unplugged.

9. A security attachment as set forth in claim 8 in which said fastener, when fully tightened against said shank, is disposed fully within said another hole.

10. A security attachment as set forth in claim 6 in which said connector element comprises a formed bracket with said another portion terminating in a flange having a hole, said first adapter comprising a hole in its body which when said first adapter and the plug are plugged together aligns with the hole in said flange, and a fastener extending through the hole in the body of said first adapter and the hole in said flange to connect same together.

11. A security attachment as set forth in claim 10 in which said fastener is constructed such that once it has been operated to connect the plug and said first adapter together, the connection cannot be non-destructively broken.

12. In combination with an electrical plug having plural male terminals of a given pattern and construction for mating engagement with corresponding female terminals of an electrical receptacle arranged in a pattern the same as said given pattern and of a construction which provides for electrical circuit continuity between mated male and female terminals when said plug is plugged in to the receptacle, means for preventing unauthorized use of said plug with the receptacle comprising means for preventing mating engagement of said male terminals of said plug with the female terminals of the receptacle comprising an adapter having a non-conducting body with plural conductors in said body terminating at respective end portions of said body in respective first and second sets of terminals, said first set of terminals comprising plural female terminals arranged in a pattern corresponding to that of said given pattern and being constructed for plug-in reception of said male terminals of said plug in mating engagement therewith so as to establish electric circuit continuity between said male terminals of said plug and said conductors of said adapter, means connecting the mated plug and adapter together to prevent the two from becoming unplugged from each other, said second set of terminals of said adapter being arranged and constructed such that they cannot be engaged with the female terminals of the receptacle in a manner which will establish electric circuit continuity between said conductors of said adapter and the female terminals of the receptacle if an attempt is made to plug said plug into the receptacle, and a second adapter for use in association between said first adapter and the receptacle to permit authorized use of said plug with the receptacle via said two adapters, said second adapter comprising a non-conducting body with plural conductors therein terminating at opposite ends thereof in respective sets of terminals, one set of said terminals of said second adapter being arranged in a pattern corresponding to that of the female terminals of the receptacle and being constructed to plug into the female terminals of the receptacle in mating engagement therewith so as to establish electric circuit continuity between the female terminals of the receptacle and said conductors of said second adapter, another set of said terminals of said second adapter being constructed and arranged to connect said conductors of said second adapter with said conductors of said first adapter so as to establish electric circuit continuity between said conductors of said second adapter and said conductors of said first adapter, and hence establish electric circuit continuity between the female terminals of the receptacle and said male terminals of said plug via said two adapters.

13. In the combination as set forth in claim 12, said plug including a body and a wire extending away from said body, said means connecting the mated plug and said first adapter together to prevent the two from becoming unplugged from each other comprising a connector element on the exterior of the bodies of said first adapter and said plug, said connector element comprising a portion encircling said wire just behind the plug body and another portion for making connection with said first adapter.

14. In the combination as set forth in claim 13, said means connecting the mated plug and said first adapter together also comprising a fastener engaging said first adapter body and connecting to said another portion of said connector element.

15. In the combination as set forth in claim 14, said first adapter body comprising a hole, said fastener passing through said hole to make connection with said another portion of said connector element.

16. In the combination as set forth in claim 15, said fastener threading into said another portion of said connector element.

17. In the combination as set forth in claim 15, said fastener threading into said hole and having an end bearing against said another portion of said connector element.

18. In combination with an electrical plug and an electrical receptacle, said plug and receptacle each having plural terminals which can be mutually plugged together, a pair of adapters each having plural conductors within an electrically non-conducting body, each adapter having a first set of terminals at one end and a second set of terminals at another end, the first set of terminals of one adapter being constructed and arranged to plug together with the terminals of said plug by pushing said plug and said first adapter toward each other to establish electric circuit continuity between the conductors of said one adapter and said plug terminals, the first set of terminals of the other adapter being constructed and arranged to plug together with the terminals of said receptacle to establish electric circuit continuity between the conductors of said other adapter and said receptacle terminals, said second sets of terminals being constructed and arranged to mutually plug together to establish electric circuit continuity between the conductors of the two adapters but to preclude said second set of terminals of said first adapter from plugging together with the terminals of said receptacle, and means to prevent said plug and said first adapter from becoming unplugged if an attempt is made to pull them apart.

* * * * *